US008057173B2

(12) United States Patent
Chen

(10) Patent No.: US 8,057,173 B2
(45) Date of Patent: Nov. 15, 2011

(54) SINGLE-BEARING FAN STRUCTURE

(75) Inventor: Ming-ju Chen, Shenzhen (CN)

(73) Assignee: Asia Vital Components ( Shen Zhen) Co., Ltd., Shenzhen (CN)

( * ) Notice: Subject to any disclaimer, the term of this patent is extended or adjusted under 35 U.S.C. 154(b) by 429 days.

(21) Appl. No.: 12/426,581

(22) Filed: Apr. 20, 2009

(65) Prior Publication Data

US 2010/0266402 A1 Oct. 21, 2010

(51) Int. Cl.
*F04D 29/059* (2006.01)

(52) U.S. Cl. ..... 415/229; 415/230; 415/231

(58) Field of Classification Search ..... 415/229–231
See application file for complete search history.

(56) References Cited

U.S. PATENT DOCUMENTS

| | | | | |
|---|---|---|---|---|
| 5,562,347 | A | 10/1996 | Hsieh | |
| 6,416,300 | B1 | 7/2002 | Tang et al. | |
| 6,699,020 | B1 | 3/2004 | Lin | |
| 2009/0016914 | A1 * | 1/2009 | Chen et al. | 417/423.7 |

* cited by examiner

*Primary Examiner* — H. Jey Tsai
(74) *Attorney, Agent, or Firm* — C. G. Mersereau; Nikolai & Mersereau, P.A.

(57) ABSTRACT

A single-bearing fan structure includes a fan frame having a bearing cup with a bearing received therein, the bearing cup having a radially inward protruded lip portion formed at a first end to abut on a top of the bearing, and a groove internally formed at a second end; a blade hub having a rotary shaft fixedly connected thereto with a distal end of the rotary shaft inserted into the bearing; a retainer engaged with the groove; a first elastic element fitted around the rotary shaft and located between the blade hub and the bearing; and a second elastic element received in the bearing cup and located between the bearing and the retainer. The first and second elastic elements and the bearing respectively axially and radially support the blade hub, enabling the fan structure to operate stably and have extended service life.

7 Claims, 4 Drawing Sheets

SINGLE-BEARING FAN STRUCTURE

FIELD OF THE INVENTION

The present invention relates to a fan structure, and more particularly to a single-bearing fan structure that includes first and second elastic elements and one single bearing to respectively provide axial and radial support to a blade hub, enabling the fan structure to have reduced manufacturing cost, stable operation, lowered noise, and extended service life.

BACKGROUND OF THE INVENTION

Following the developments in different technological fields, more and more finely designed and high-power products have been introduced into the market. However, the high-power products would inevitably produce high temperature during the operation thereof to endanger the products. The electronic elements in the products might become burned-out to cause failed products or even more serious problems. Therefore, most of the precision products are provided with a cooling fan to force away the heat produced by the products during the operation thereof.

FIGS. 1A and 1B are exploded and assembled sectional views, respectively, of a conventional dual-bearing fan structure. As shown, the dual-bearing fan structure includes a fan frame 10 and a blade hub 11. The fan frame 10 is provided at a central portion with a base 101, which has an open end 102 and a closed end 103. A first bearing 12, a second bearing 13, and a spring element 14 are received in the base 101. A radially inward annular protrusion 104 is formed in the base 101, so that the first and the second bearing 12, 13 are separately located at two axially opposite sides of the annular protrusion 104.

The blade hub 11 has a rotary shaft 110, which has a proximal end embedded in the blade hub 11 and a distal end extended into the base 101 through the spring element 14 and the first and second bearing 12, 13 to project from the second bearing 13 into the closed end of the base 101. A stop ring 15 is connected to the distal end of the rotary shaft 110 in the closed end of the base 101, 50 as to hold the second bearing 13 in place in the base 101. The spring element 14 is put around the rotary shaft 110 and located above the first bearing 12 in the open end 102 of the base 101, such that two ends of the spring element 14 are tightly pressed against the blade hub 11 and the first bearing 12. When the dual-bearing fan operates, the first and the second bearing 12, 13 together radially support the blade hub 11 for the same to rotate, so that blades on blade hub 11 of the dual-bearing fan structure can be rotated rapidly.

The base 101 of the fan frame 10 is formed by injection molding. On injection molding, it is difficult to control the concentricity of the spaces in the base 101 at two axially opposite sides of the annular protrusion 104 for separately holding the first and the second bearing 12, 13. Therefore, when assembling the rotary shaft 110 of the blade hub 11 to the first and the second bearing 12, 13, it is uneasy to control the concentricity between the first and the second bearing 12, 13 and the perpendicularity of the inner bore of the base 101. As a result, when the fan structure operates, abnormal wearing tends to occur on the rotary shaft 110 and the first and second bearings 12, 13, which will produce noise and shorten the service life of the fan.

By providing two bearings to enable the fan structure to operation, the manufacturing cost of the fan will correspondingly increase. Moreover, for a super slim-type fan, there would not be sufficient space for two ball bearings. Therefore, the normal bearings must be replaced by ball bearings with smaller size to also increase the manufacturing cost of the fan.

In brief, the conventional dual-bearing fan structure has the following disadvantages: (1) increased manufacturing cost; (2) uneasy to control the concentricity between the two bearings when assembling the fan structure; (3) producing noise during operation; and (4) shortened service life.

It is therefore tried by the inventor to develop an improved single-bearing fan structure to overcome the problems in the conventional dual-bearing fan structure.

SUMMARY OF THE INVENTION

A primary object of the present invention is to provide a single-bearing fan structure, which has a blade hub being axially supported by two elastic elements and radially supported by one single bearing to achieve stable operation of the fan structure.

Another object of the present invention is to provide a single-bearing fan structure that can be manufactured at reduced cost.

A further object of the present invention is to provide a single-bearing fan structure that can reduce noise produced by the fan structure during the operation thereof.

A still further object of the present invention is to provide a single-bearing fan structure that enables extended service life of the fan.

A still further object of the present invention is to provide a single-bearing fan structure that can be applied to fans of different thicknesses.

To achieve the above and other objects, the single-bearing fan structure according to the present invention includes a fan frame, a blade hub, a retainer, a first elastic element, and a second elastic element. The fan frame includes a bearing cup having a bearing received therein. The bearing cup has a first end and a second end, the first end has a lip portion radially protruded toward a centerline of the bearing cup to abut on a top of the bearing, and the bearing cup is provided on an inner space adjacent to the second end with a groove. The blade hub includes a rotary shaft having a proximal end fixedly connected to the blade hub and a distal end inserted into the bearing. The retainer is connected to the second end of the bearing cup and provided with at least one retaining portion for engaging with the groove. The first elastic element is fitted around the rotary shaft and located between the blade hub and the bearing with a first end portion pressed against the blade hub and a second end portion pressed against the bearing. The second elastic element is received in the bearing cup and located between the bearing and the retainer with a third end portion pressed against the bearing and a fourth end portion pressed against the retainer. The first and second elastic elements and the single bearing respectively provide axial and radial support to the blade hub, enabling the fan structure to have reduced manufacturing cost, stable operation, lowered noise, and extended service life.

BRIEF DESCRIPTION OF THE DRAWINGS

The structure and the technical means adopted by the present invention to achieve the above and other objects can be best understood by referring to the following detailed description of the preferred embodiments and the accompanying drawings, wherein.

DETAILED DESCRIPTION OF THE PREFERRED EMBODIMENTS

Figure 1A:
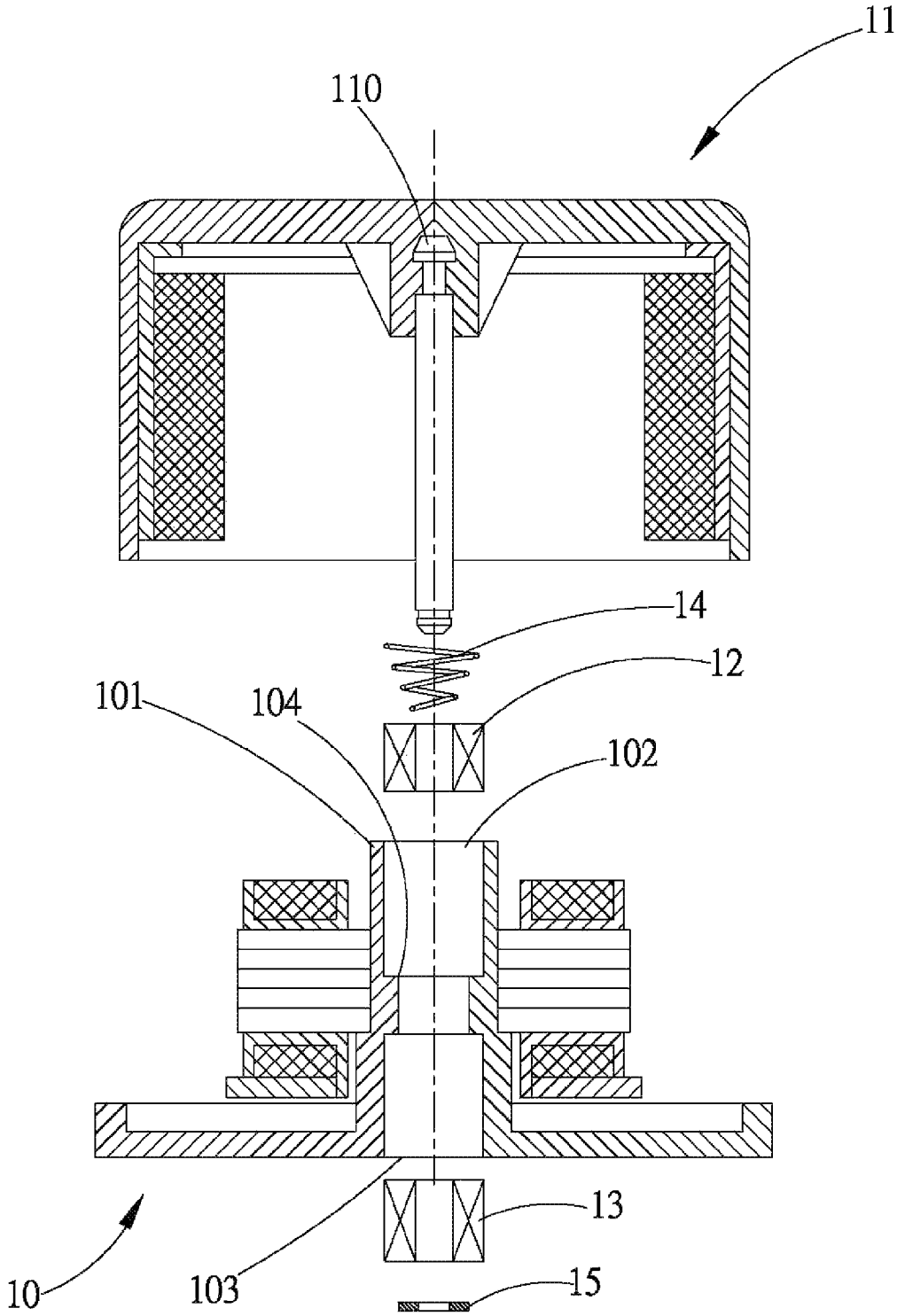
Fig.1A(PRIOR ART)
FIG. 1A is an exploded sectional view of a conventional dual-bearing fan structure.
Figure 1B:
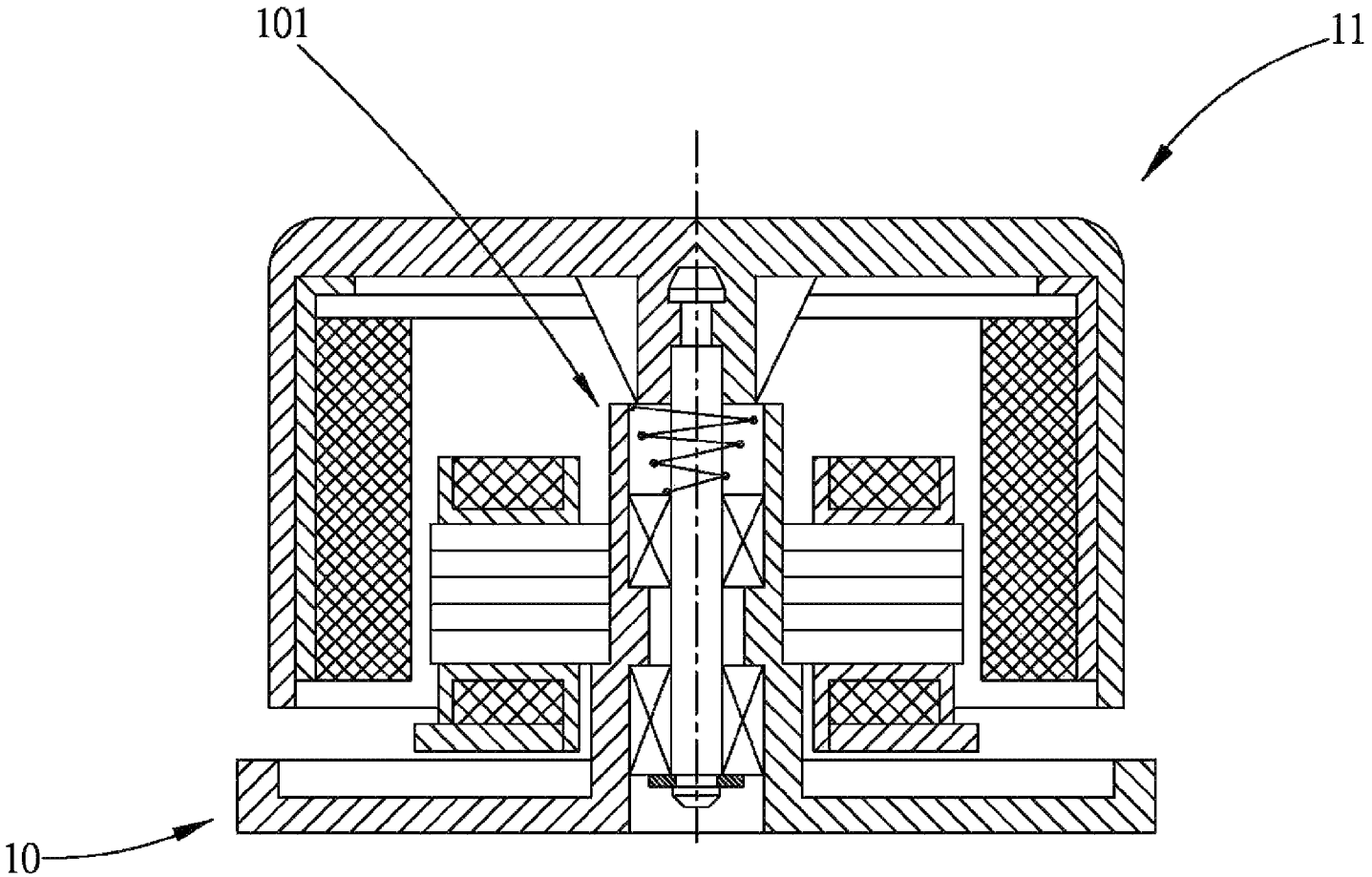
Fig.1B(PRIOR ART)
FIG. 1B is an assembled view of FIG. 1.
Figure 2:
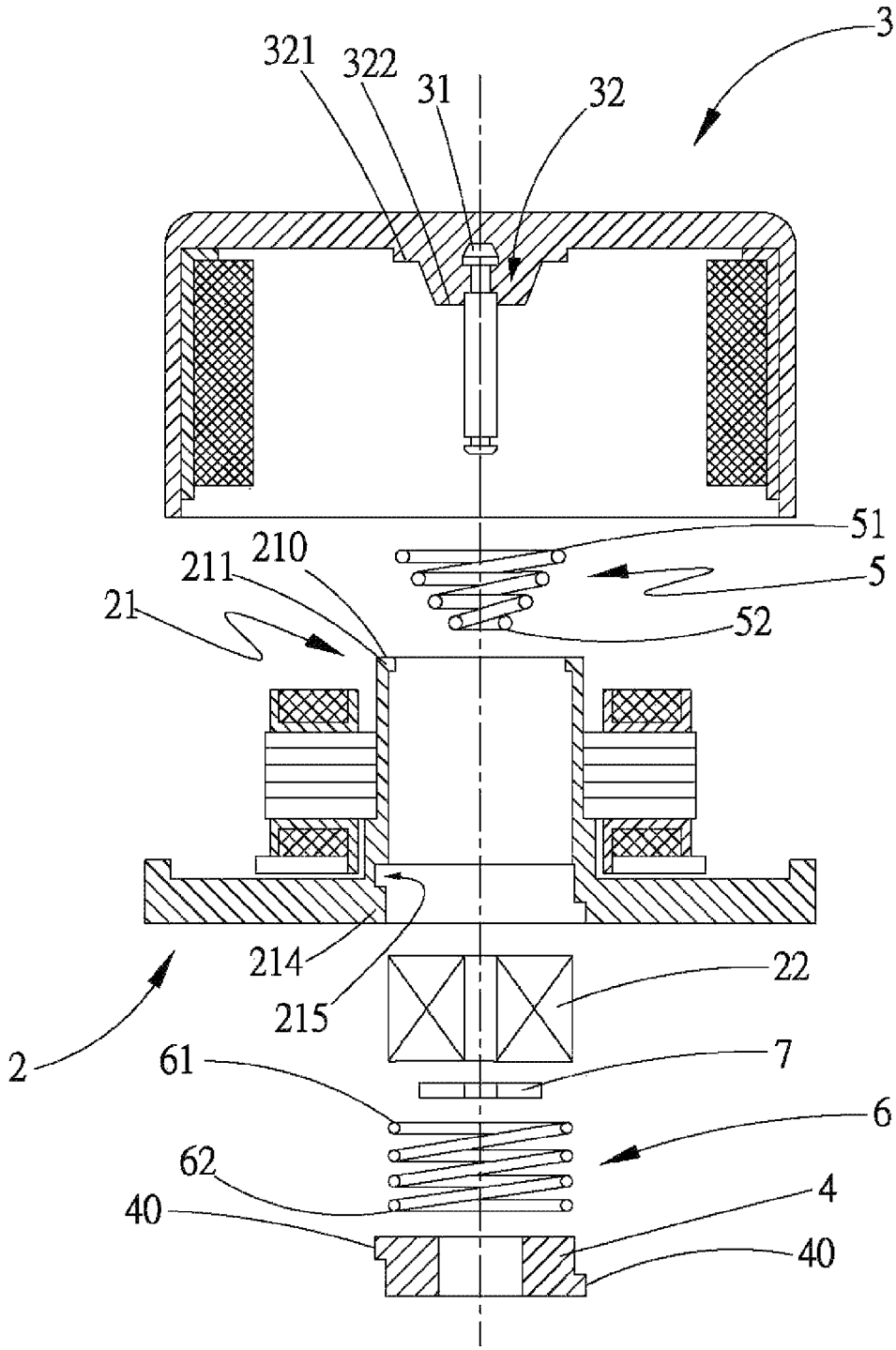
FIG. 2 is an exploded sectional view of a single-bearing fan structure according to a preferred embodiment of the present invention.
Figure 3:
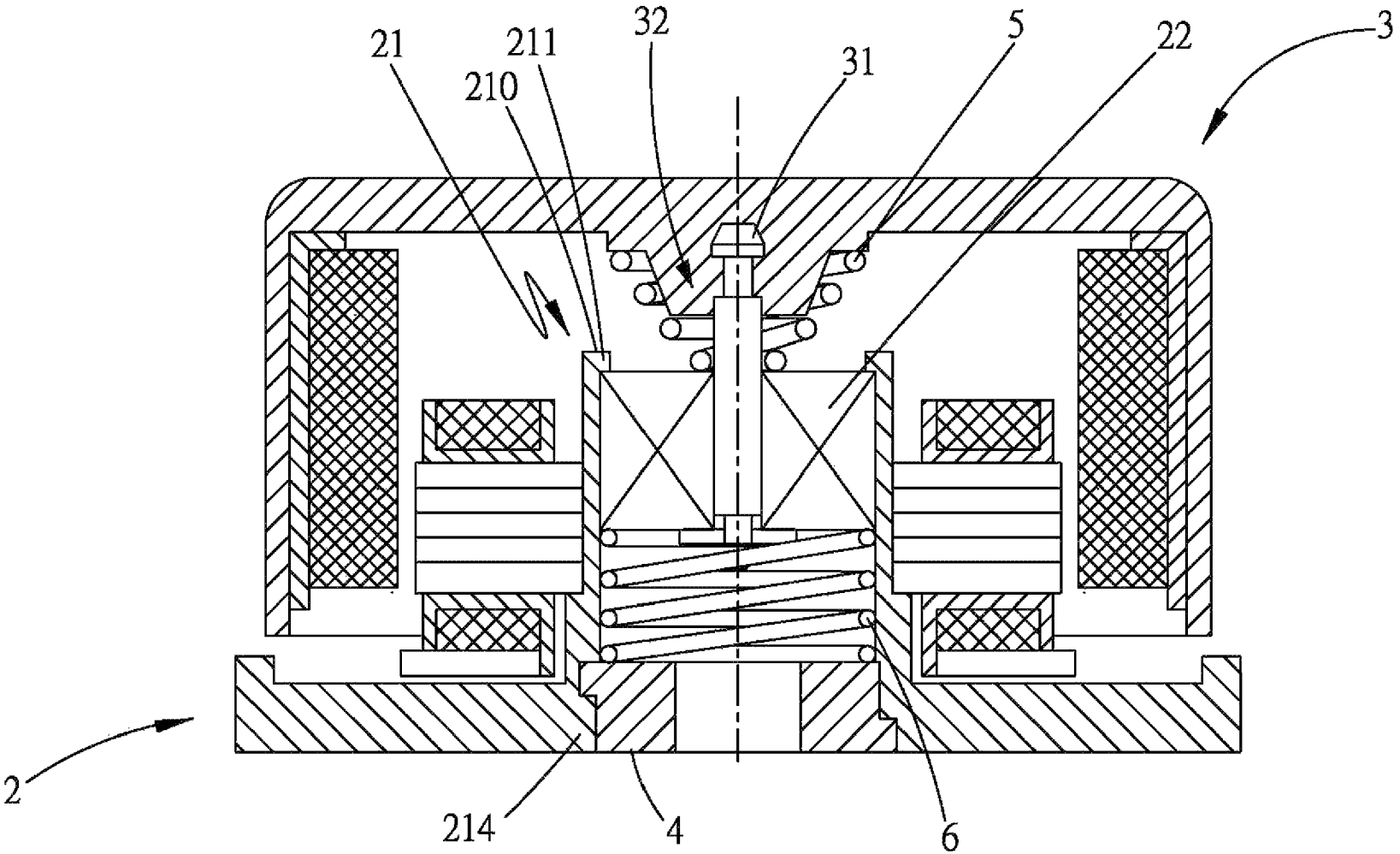
FIG. 3 is an assembled view of FIG. 2.

Please refer to FIGS. 2 and 3 that are exploded and assembled sectional views, respectively, of a single-bearing fan structure according to a preferred embodiment of the present invention. As shown, the single-bearing fan structure includes a fan frame 2, a blade hub 3, a retainer 4, a first elastic element 5, and a second elastic element 6. The fan frame 2 includes a bearing cup 21 with a bearing 22 received therein. The bearing cup 21 has a first end 210 and a second end 214. The first end 210 of the bearing cup 21 is provided with a lip portion 211 radially protruded toward a centerline of the bearing cup 21 to abut on the bearing 22. The bearing cup 21 is provided on an inner side at a position adjacent to the second end 214 with a groove 215 for correspondingly engaging with the retainer 4. The bearing 22 is a single ball bearing for supporting blades formed on the blade hub 3 to rotate.

The blade hub 3 includes a rotary shaft 31, which has a proximal end fixedly connected to the blade hub 3 and a distal end inserted into the bearing cup 21 through the bearing 22. In other words, the distal end of the rotary shaft 31 is extended through an end of the bearing 22 to project from the other end of the bearing 22 into the second elastic element 6. And, an engaging member 7 is fixedly connected to the distal end of the rotary shaft 31.

The retainer 4 is mounted to the second end 214 of the bearing cup 21, and has at least one retaining portion 40 for engaging with the groove 215. The first elastic element 5 is put around the rotary shaft 31 and located between the blade hub 3 and the bearing 22. The first elastic element 5 is a conical spring having a first end portion 51 abutted on the blade hub 3 and a second end portion 52 abutted on the bearing 22.

The second elastic element 6 is received in the bearing cup 21 to locate between the bearing 22 and the retainer 4. The second elastic element 6 has a third end portion 61 abutted on the bearing 22 and a fourth end portion 62 abutted on the retainer 4. Therefore, the blade hub 3 is supported by an assembly of the first and the second elastic element 5, 6 and the bearing 22 to rotate stably. With these arrangements, the fan structure can be manufactured at effectively reduced cost and operate with decreased noise and enhanced operating stability, allowing the fan structure to have extended service life. When viewing from this aspect, the single-bearing fan structure of the present invention has exactly overcome the disadvantages in the prior art, including high manufacturing cost, uneasy to control the concentricity of two bearings, easy to produce noise, high damage rate, and shortened service life.

What is to be noted is the single-bearing fan structure of the present invention can be applied to fans of different overall thicknesses. In the case of a slim-type fan structure, simply adjust the lengths of the first and the second elastic element 5, 6 to thereby adjust an axial height of the bearing 22 for designing fans structure of different thicknesses.

As can be seen from FIGS. 2 and 3, the blade hub 3 is provided on an inner side with a protruded seat 32 corresponding to the rotary shaft 31. The protruded seat 32 is extended toward the bearing cup 21 and has at least a first portion 321 and a second portion 322. The first portion 321 is extended from the inner side of the blade hub 3 and the second portion 322 is extended from the first portion 321, such that the seat 32 has a substantially stepped configuration. Further, the first end portion 51 of the first elastic element 51 has an outer diameter larger than that of the second end portion 52; and the first end portion 51 is snug-fitted around the stepped seat 32 while the second end portion 52 is fitted around the rotary shaft 31.

To assemble the fan, first fit the first elastic element 5 around the rotary shaft 31 of the blade hub 3, such that the first end portion 51 of the first elastic element 5 is firmly pressed against the first and the second portion 321, 322 of the stepped seat 32 while the second end portion 52 of the first elastic element 5 is pressed against a top of the bearing 22. When the rotary shaft 31 of the blade hub 3 has been inserted into the bearing 22, the top of the bearing 22 received in the bearing cup 21 is pressed against the lip portion 211 at the first end 210 of the bearing cup 21, and a bottom of the bearing 22 is held in place by the engaging member 7 that is fixedly connected to the distal end of the rotary shaft 31. Therefore, the bearing 22 can be stably located in the bearing cup 21 of the fan frame 2.

Meanwhile, the third and the fourth end portion 61, 62 of the second elastic element 6 in the bearing cup 21 are respectively pressed against the bottom of the bearing 22 and the retainer 4. Since the retaining portion 40 of the retainer 4 has already been engaged with the corresponding groove 215, the concentricity of the bearing 22 is not a problem on assembling the fan structure. Therefore, molds for forming the bearing 22 and other parts of the fan structure can be more easily controlled in terms of accuracy in dimensions. Without the problem of concentricity, the fan structure can be quickly and conveniently assembled to reduce the manufacturing cost thereof. Meanwhile, the fan structure can operate without producing loud noise and have increased service life.

Moreover, when the fan structure operates, since the blade hub 3 is axially supported by the first and the second elastic element 5, 6 and radially supported by the bearing 22, stable operation of the fan structure can be ensured.

In brief, the single-bearing fan structure according to the present invention provides at least the following advantages: (1) reduced manufacturing cost; (2) lowered operating noise; (3) increased fan service life; (4) without the problem of concentricity during fan assembly to enable easy control of mold fabrication; and (5) applicable to fans of different thicknesses.

The present invention has been described with a preferred embodiment thereof and it is understood that many changes and modifications in the described embodiment can be carried out without departing from the scope and the spirit of the invention that is intended to be limited only by the appended claims.

What is claimed is:

1. A single-bearing fan structure, comprising:

a fan frame including a bearing cup with a bearing received therein, the bearing cup having a first end and a second end, the first end of the bearing cup being provided with a lip portion radially protruded toward a centerline of the bearing cup to bear against the bearing, and the bearing cup being provided on an inner side at a position adjacent to the second end with a groove;

a blade hub including a rotary shaft having a proximal end fixedly connected to the blade hub and a distal end inserted into the bearing;

a retainer being mounted to the second end of the bearing cup and provided with at least one retaining portion for engaging with the groove;

a first elastic element being put around the rotary shaft and located between the blade hub and the bearing, the first elastic element having a first end portion pressed against the blade hub and a second end portion pressed against the bearing; and a second elastic element being received in the bearing cup and located between the bearing and the retainer, and the second elastic element having a third end portion pressed against the bearing and a fourth end portion pressed against the retainer.

2. The single-bearing fan structure as claimed in claim 1, wherein the blade hub is provided on an inner side corresponding to the rotary shaft with a protruded seat extended toward the bearing cup.

3. The single-bearing fan structure as claimed in claim 2, wherein the first end portion of the first elastic element has an outer diameter larger than that of the second end portion of the first elastic element, and the first end portion being fitted around the protruded seat while the second end portion is fitted around the rotary shaft.

4. The single-bearing fan structure as claimed in claim 2, wherein the protruded seat includes at least a first portion extended from the inner side of the blade hub and a second portion extended from the first portion.

5. The single-bearing fan structure as claimed in claim 1, wherein the first elastic element is a conical spring.

6. The single-bearing fan structure as claimed in claim 1, wherein the distal end of the rotary shaft is extended through the bearing into the second elastic element to fixedly engage with an engaging member.

7. The single-bearing fan structure as claimed in claim 1, wherein the bearing is a single ball bearing for supporting blades provided on the blade hub to rotate.

* * * * *